US011136092B1

(12) United States Patent
Mohrfeld

(10) Patent No.: US 11,136,092 B1
(45) Date of Patent: Oct. 5, 2021

(54) VENT CAP SYSTEM

(71) Applicant: James Mohrfeld, Tomball, TX (US)

(72) Inventor: James Mohrfeld, Tomball, TX (US)

( * ) Notice: Subject to any disclaimer, the term of this patent is extended or adjusted under 35 U.S.C. 154(b) by 0 days.

(21) Appl. No.: 16/945,417

(22) Filed: Jul. 31, 2020

(51) Int. Cl.

| | |
|---|---|
| ***B63B 21/27*** | (2006.01) |
| ***B63B 21/50*** | (2006.01) |
| ***E02D 5/22*** | (2006.01) |
| ***B63B 35/44*** | (2006.01) |
| *E21B 41/00* | (2006.01) |

(52) U.S. Cl.
CPC ..... *B63B 21/27* (2013.01); *B63B 21/50* (2013.01); *B63B 35/4413* (2013.01); *E02D 5/22* (2013.01); *E02D 2250/0053* (2013.01); *E21B 41/0007* (2013.01)

(58) Field of Classification Search
CPC ..... B63B 21/27; B63B 21/50; B63B 35/4413; E02D 5/22; E02D 2250/0053; E21B 41/0007
USPC ..... 405/224, 224.1; 114/296
See application file for complete search history.

(56) References Cited

U.S. PATENT DOCUMENTS 3,156,441 A * 11/1964 Thorn ..... B64D 37/005 244/135 R
6,122,847 A * 9/2000 Treu ..... B63B 21/22 37/345
6,322,439 B1 * 11/2001 David ..... B60H 1/262 454/145
6,719,496 B1 * 4/2004 Von Eberstein ..... B63B 21/22 114/296
8,021,082 B2 * 9/2011 Thomas ..... B63B 21/27 405/224.1
9,221,522 B2 * 12/2015 Mohrfeld ..... B63B 21/27
9,458,595 B2 * 10/2016 Mohrfeld ..... E02D 31/10
2006/0127187 A1 * 6/2006 Raines ..... B63B 21/29 405/226
2008/0292409 A1 * 11/2008 Alhayari ..... B63B 21/27 405/228
2009/0297276 A1 * 12/2009 Foo ..... B63B 21/27 405/224
2012/0006557 A1 * 1/2012 Fraser ..... E21B 33/038 166/350
2012/0024535 A1 * 2/2012 Lieske, II ..... E21B 43/0122 166/363
2013/0220206 A1 * 8/2013 Mogedal ..... E21B 41/08 114/296

* cited by examiner

*Primary Examiner* — Edwin J Toledo-Duran
(74) *Attorney, Agent, or Firm* — Craft Chu PLLC; Andrew W. Chu

(57) ABSTRACT

The vent cap system for a suction pile includes a top plate, a center stem assembly, a bottom plate, a flange assembly, and perimeter stem assemblies. The bottom plate moves between an opened position and a closed position. The center stem assembly is in direct threaded engagement with the top plate, and the perimeter stem assemblies and stem retainer cooperate to maintain alignment of the bottom plate. A pipe plug to test the sealing engagement is placed on the bottom plate, instead of the flange assembly. There is a closing lip of the bottom plate so that a sealing diameter can be the smallest diameter of the flange assembly, which reduces force on the bottom plate from under the bottom plate. There is a connection portion of the flange assembly to attach the system to the suction pile so that weld deformation does not affect the entire flange assembly.

16 Claims, 3 Drawing Sheets

VENT CAP SYSTEM

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a valve. In particular, the present invention relates to a vent valve system. More particularly, the present invention relates to a vent cap system with supported alignment of a bottom plate relative to a flange assembly in a closed position, an opened position, and transitions between the closed position and the opened position. The present invention has improved cost efficiency in manufacturing and sufficient durability for installation on a suction pile.

2. Description of Related Art Including Information Disclosed Under 37 CFR 1.97 and 37 CFR 1.98

A suction pile (also known as a suction caisson, a suction anchor, and a suction bucket) is used to moor a subsea drilling rig or production ship to the ocean floor. The suction pile is attached to the ocean floor, and rig structures are anchored to the attached suction pile. The suction pile is comprised of a generally tubular body, launched into the water and lowered down to the ocean floor. The open end of the tubular body embeds into the ocean floor, like an upside down bucket faced down in the soil. There is a closed end of the tubular body with a vent hatch. The vent hatch has an opened position and a closed position, and a remote operated vehicle (ROV) is used to move the vent hatch between these two positions. The opened position is used during deployment to the ocean floor, with water flowing through the tubular body by the vent hatch. Once landed, tubular body self-embeds into the ocean floor by sheer weight and momentum. The suction pile is partially embedded when landed. For complete embedding, the closed position is used to seal the suction pile, so that air and water remaining in the tubular body are pumped out. An ROV can attach a hose to a suction port on the tubular body. The suction pile is sucked into the ocean floor until being solidly embedded into the ocean floor to a desired depth. The ROV removes hose and seals the suction port.

The set embedded suction pile at the desired depth forms a solid base for mooring a drilling rig structures. Suction piles as anchoring means for rigs and other oil and gas exploration installations are known. The suction pile may also function as a foundation for manifolds. A manifold can be set on top of the suction pile or a plurality of suction piles. Thus, the manifold is installed in a subsea location for access to multiple wells. The manifold on the suction pile can maintain multiple production flowline headers at a subsea location. For the suction pile as an anchor for a rig or foundation for a manifold, the vent hatch remains closed and sealed on the suction pile.

Variations of suction piles are known in the prior art. For example, United States Patent Publication No. 20060127187, published for Raines on Jun. 15, 2006, discloses a conventional anchor system with a variation on the suction pile structure. There is an elongated hollow anchor element releasably attached to an installation element.

The use of ROV technology to facilitate the embedding of a suction pile is also well known. United States Patent Publication No. 20090297276, published for Foo et al., on Dec. 3, 2009 discloses installation using the ROV instead of an aiming mechanism on the anchoring element of the suction pile. U.S. Pat. No. 6,719,496, issued to Eberstein on Apr. 13, 2004, also describes a system with ROV intervention to install a suction pile. The ROV with pump capability closes the flood valves on the top of the suction pile and attaches to the pumping port of the suction pile. The pump of the ROV operates to draw down the suction pile. The ROV disconnects from the pump port and connects a mooring line to secure the load connection.

Variations of the vent hatch or vent cap of the suction pile are also known in the prior art. The primary type of vent hatch for a suction pile is the hinged cap. United States Patent Publication No. 20130220206, published for Mogedal et al on Aug. 29, 2013, shows a vent cap as a hinged cap with a frame to insure alignment of the cap plate over the hatch. Another type of vent hatch is the butterfly valve, shown in U.S. Pat. No. 6,719,496, issued to Eberstein on Apr. 13, 2004, with a cap plate swiveling over the hatch for opening and closure. Some vent hatches are combinations of the hinged cap and the butterfly valves, such as U.S. Pat. No. 6,322,439, issued to David on Nov. 27, 2001. The hinge elements transition between the traditional flipping hinged cap with the cap plate lifted from the hatch and the traditional butterfly vent cap with the cap plate swiveling over the hatch.

U.S. Pat. No. 9,221,522, issued to Mohrfeld on 29 Dec. 2015, discloses a vent cap system for a suction pile. The vent cap system can be oriented in both vertical and horizontal positions on the suction pile with additional supports and bracing to avoid altering alignment of the closed position of a bottom plate. U.S. Pat. No. 9,458,595, issued to Mohrfeld on 4 Oct. 2016, discloses a heavy duty vent cap system with additional braces and supports. The number, strength, and weight of components increase to handle larger and larger suction piles and force requirements.

It is an object of the present invention to provide an embodiment of a vent valve system for a suction pile.

It is an object of the present invention to provide an embodiment of a vent cap system being actuated between a closed position and an opened position in a very limited space application.

It is another object of the present invention to provide an embodiment of a vent cap system with improved cost efficiency in manufacturing.

It is still another object of the present invention to provide an embodiment of a vent cap system that supports a center stem assembly relative to the bottom plate.

It is yet another object of the present invention to provide an embodiment of a vent cap system that supports the bottom plate back and forth from the opened position to the closed position.

It is yet another object of the present invention to provide an embodiment of a vent cap system that stabilizes the seal of the bottom plate to the flange assembly in the closed position.

It is an object of the present invention to provide an embodiment of a vent cap system that requires less force to maintain a seal in the closed position.

It is an object of the present invention to provide an embodiment of a vent cap system able to withstand weld deformation of the flange assembly.

These and other objects and advantages of the present invention will become apparent from a reading of the attached specification.

BRIEF SUMMARY OF THE INVENTION

Embodiments of the present invention include a vent cap system for a suction pile. The vent cap system includes a top plate, a center stem assembly, a bottom plate, a flange assembly, and perimeter stem assemblies. The bottom plate moves between an opened position and a closed position. The center stem assembly is in direct threaded engagement with the top plate, and the perimeter stem assemblies and stem retainer cooperate to maintain alignment of the bottom plate relative to the flange assembly during movement between opened position and closed position. The seal of the bottom plate to the flange assembly in the closed position is verified by a pipe plug to test the sealing engagement being on the bottom plate, instead of the flange assembly so that there no required interface within the flange assembly in order test the seal.

In the present invention, there is a closing lip on the upper surface of the bottom plate that sets the fully closed position. The closing lip abuts the flange assembly due to the larger diameter of the closing lip. This friction fit relationship of the closing lip and the flange assembly stops bottom plate movement, when exterior top pressure is applied to the vent cap system. For under pressure from the bottom, the vent cap system includes the center stem assembly, the threaded stem portion, the threaded center top plate hole, and the top plate positioned by the stem assemblies to stop bottom plate movement.

Embodiments of the invention also include the connection portion of the flange assembly with a welding diameter larger than the sealing diameter and smaller thickness. The weld deformation to attach to the suction pile now only affects the connection portion, instead of the entire flange assembly with the sealing portion.

DETAILED DESCRIPTION OF THE INVENTION

Figure 1:
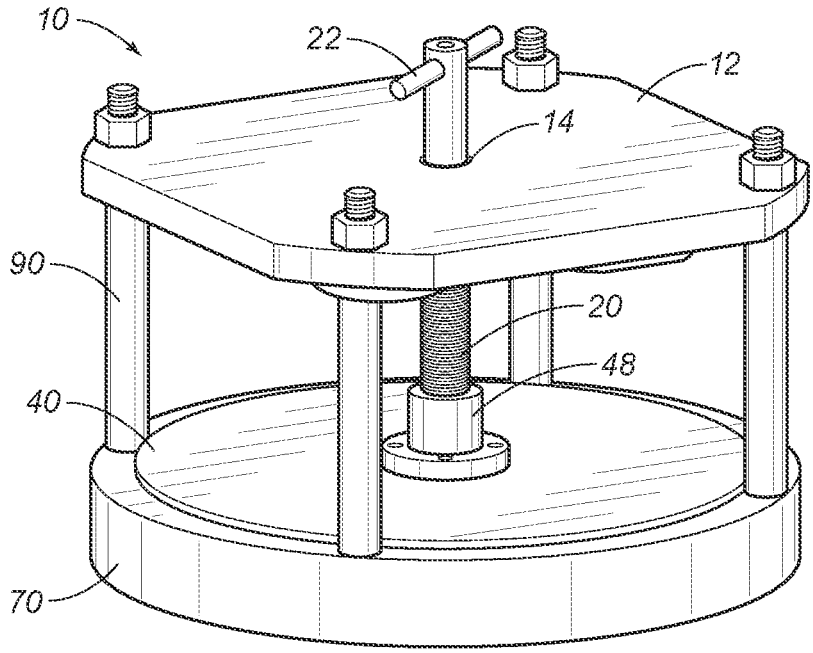
FIG. 1 is a perspective view of an embodiment of the vent cap system according to the present invention.
Figure 2:
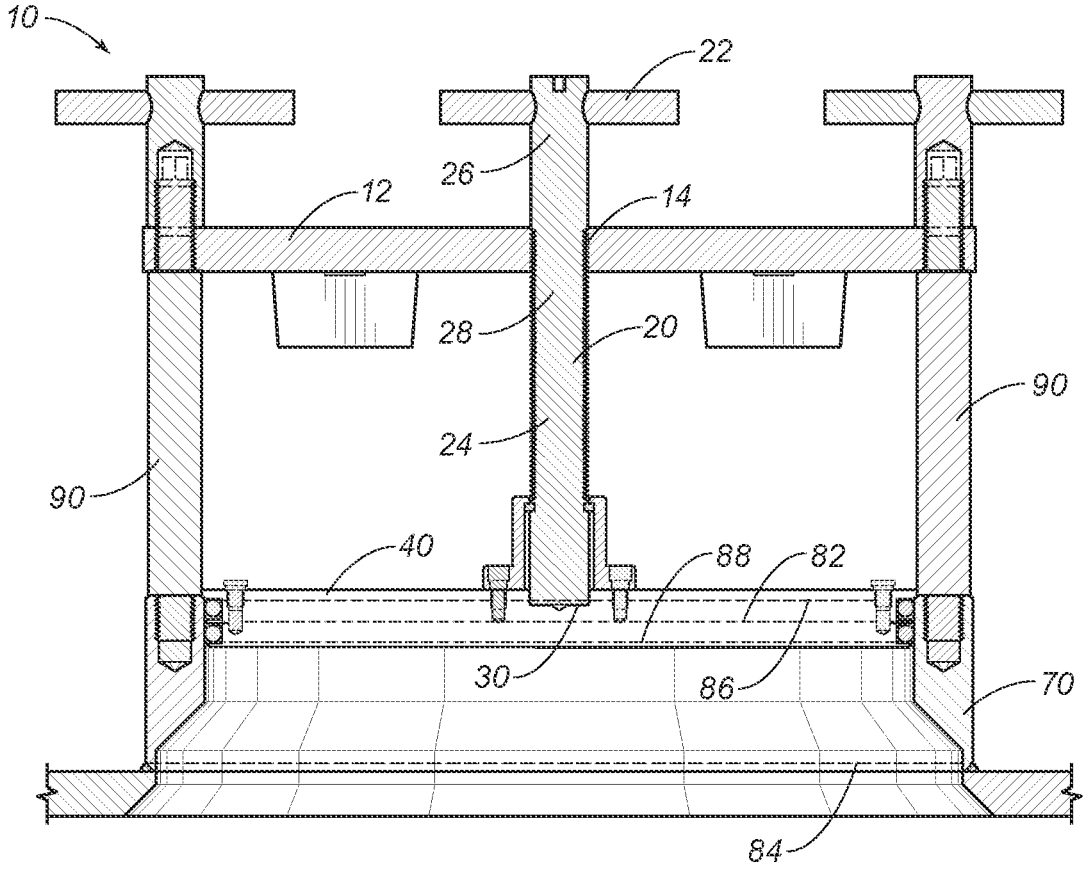
FIG. 2 is a sectional view of the vent cap system according to the present invention.
Figure 3:
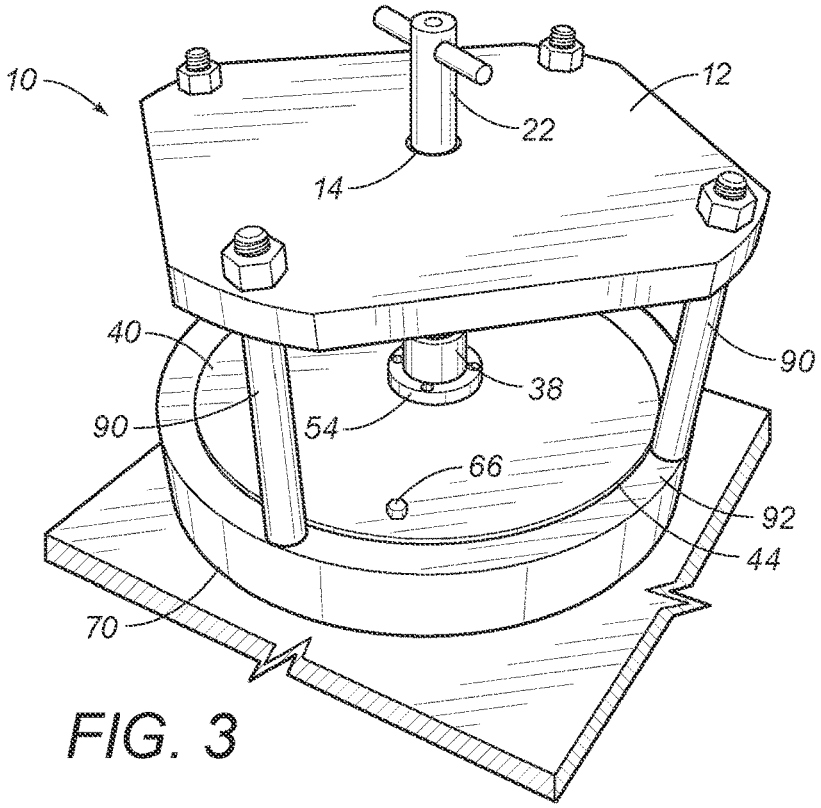
FIG. 3 is a perspective view of the vent cap system according to the present invention with the bottom plate in the closed position.

Referring to FIGS. 1-6, the present invention is a vent cap system 10 for a suction pile. The vent cap system 10 mounts on the top of the suction pile, where space is limited and where maximum flow is required. The vent cap system 10 comprises a top plate 12, a center stem assembly 20, a bottom plate 40, a flange assembly 70, and perimeter stem assemblies 90. The bottom plate 40 can be moved between an opened position (FIG. 4) and a closed position (FIG. 3). In the opened position, the suction pile can be deployed to a subsea location, which requires the maximum flow of water through the suction pile. Once embedded at the subsea location, the closed position allows pumping from the suction pile in order to penetrate the suction pile to a desired depth.

Embodiments of the vent cap system 10 include the top plate 12 having a threaded center top plate hole 14. The center stem assembly 20 is comprised of a center stem handle 22, and a center stem bolt body 24 as in FIGS. 1-2. The center stem bolt body 24 has a distal end 26, a threaded stem portion 28, and a proximal end 30 opposite the distal end 26. The threaded stem portion 28 is between the distal end 26 and the proximal end 30. The center stem handle 22 is mounted on the distal end 26 above the top plate 12. The threaded center stem bolt body 24 is extended through the top plate 12, and the threaded stem portion 28 is in threaded engagement with the threaded center top plate hole 14. Rotation of the center stem handle 22 by a remote operated vehicle (ROV) can actuate the vent cap system 10 so that the bottom plate 40 moves between the opened position and the closed position.

FIGS. 2 and 4-6 show embodiments of the bottom plate 40 having an upper surface 42, an outer circumference 44, and a lower surface 46 opposite the top surface. The diameter 86 of the upper surface 42 of the bottom plate 40 is shown in FIG. 2. The upper surface 42 has an upper surface diameter 86 larger than a lower surface diameter 88 of the lower surface 46 so as to form a closing lip 52.

Figure 4:
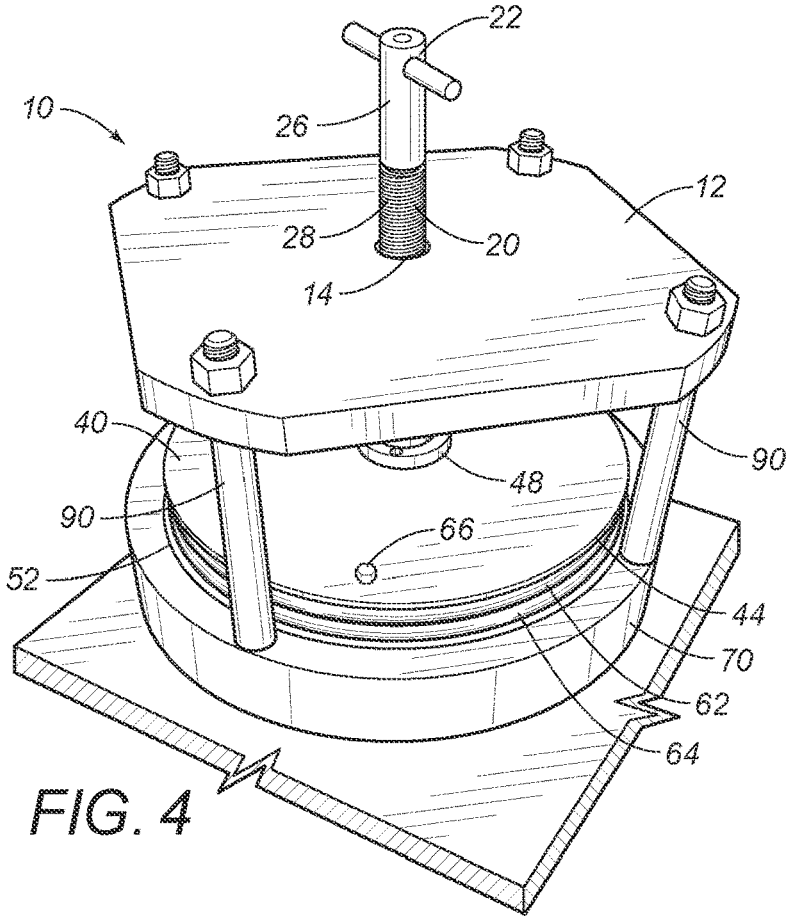
FIG. 4 is a perspective view of the vent cap system according to the present invention with the bottom plate in a partially opened position.
Figure 5:
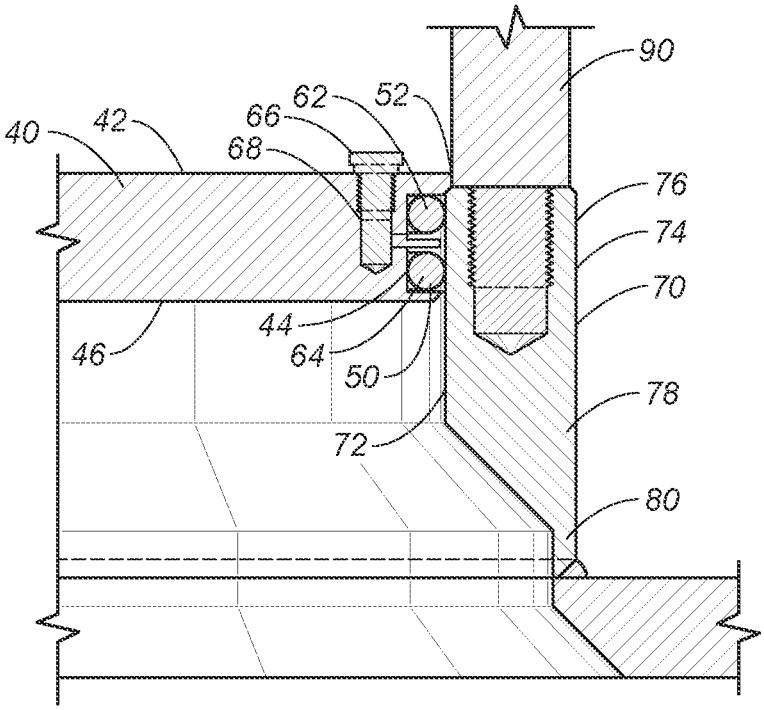
FIG. 5 is an enlarged sectional view of an embodiment of the flange assembly, and bottom plate of the vent cap system, according to the present invention.

The bottom plate 40 also includes a stem retainer 48 and a sealing means 50. FIGS. 1-3 and 6 show the stem retainer 48 centered on the upper surface 42 of the bottom plate 40 and removably attached to the center stem bolt body 24. The proximal end 30 of the center stem bolt body 24 is attached to the bottom plate 40. FIGS. 2, 4 and 5 show the sealing means 50 positioned on the outer circumference 44 of the bottom plate 40.

The vent cap system 10 also includes the flange assembly 70 having an inner flange surface 72 and an outer flange surface 74 opposite the inner flange surface 72 as in FIG. 5. The flange assembly 70 is comprised of a sealing portion 76, a transition portion 78, and a connection portion 80. The sealing portion 76 faces toward the top plate 12 and engages the perimeter stem assemblies 90. The sealing portion 76 can be in sealed engagement with the bottom plate 40 in the closed position. The connection portion faces away from the top plate 12 and can be welded to the suction pile. There is the transition portion 78 between the sealing portion 76 and the connection portion 80.

FIG. 2 show the diameters of the present invention. The sealing portion 76 has a sealing diameter 82. The connection portion 80 has a welding diameter 84. The bottom plate 40 has the upper surface diameter 86 and the lower surface diameter 88. In the present invention, the sealing diameter 82 is smaller than the welding diameter 84 and smaller than the upper surface diameter 86 of the bottom plate 40. The closing lip 52 of the bottom plate 40 abuts the flange assembly 70 in the closed position. The bottom plate 40 is friction fit against the flange assembly 70 by the closing lip 52. The sealing diameter 82 and the lower surface diameter 88 position a sealing engagement between the bottom plate 40 and the flange assembly 70.

Embodiments of the vent cap system 10 further include a plurality of perimeter stem assemblies 90. Each perimeter stem assembly 90 can be arranged on a perimeter 92 of the flange assembly 70 so as to maintain position of the top plate 12 relative to the flange assembly 70 during raising and lowering of the bottom plate 40 between the opened position and the closed position. The perimeter stem assemblies 90 are also in sliding engagement with the bottom plate 40 so as to guide the bottom plate 40 between the opened position and the closed position. The perimeter stem assemblies 90 are in contact with the bottom plate 40 so that the bottom plate 40 maintains alignment to be centered and fits in and out of the flange assembly 70 with the sealing engagement at the outer circumference 44 of the bottom plate 40 and the inner flange surface 72 of the flange assembly 70. Fewer components for centering the bottom plate 40 are required with this position of the perimeter stem assemblies 90. The perimeter stem assemblies 90 can be radially arranged around the perimeter 92 and can be selected from a group consisting of T-handles, as shown in FIG. 2 and hex bolts, as shown in FIGS. 1, 3 and 4.

Figure 6:
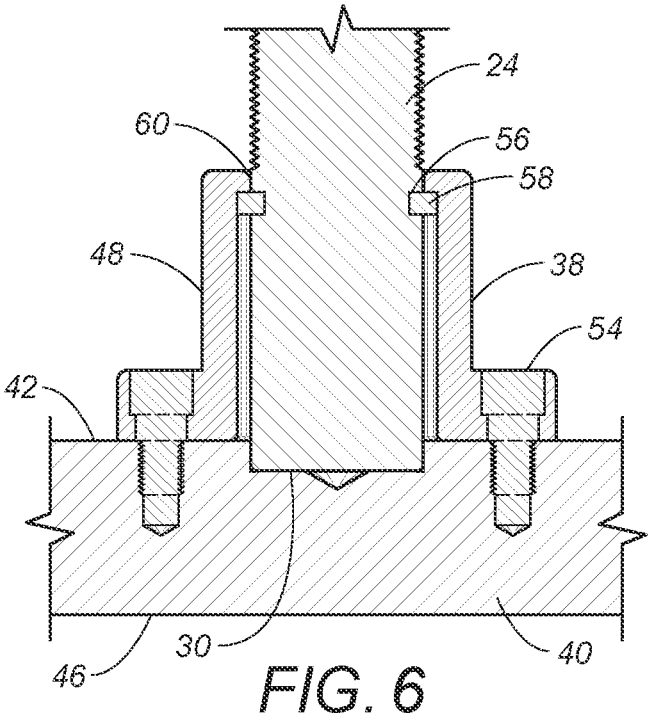
FIG. 6 is an enlarged sectional view of an embodiment of the center stem assembly, stem retainer, and bottom plate of the vent cap system, according to the present invention.

FIG. 6 shows an embodiment of the stem retainer 48 being comprised of a mounting plate 54 attached to the upper surface 42 of the bottom plate 40, and a stem sleeve 38 orthogonal to the mounting plate 54. The stem sleeve 38 also attaches to the center stem bolt body 24 of the center stem assembly 20. The stem retainer 48 maintains the bottom plate 40 perpendicular to center stem assembly 20. In combination with the perimeter stem assemblies 90, the vent cap system 10 maintains alignment of the bottom plate 40 without additional components, weight, and costs. The stem sleeve 38 extends upward from the mounting plate 54 toward the top plate 12. The stem sleeve 38 has a variable size, depending on diameter and weight of the bottom plate 40 and center stem assembly 20. There is additional support by the perimeter stem assemblies 90 also.

In one embodiment, the center stem assembly 20 has a retainer groove 56 positioned on the center stem bolt body 24 so as to be enclosed by the stem retainer 48. There can be a bearing ring 58 within the retainer groove 56. The bearing ring 58 is slip fit between the retainer groove 56 of the center stem assembly 20 and the stem sleeve 38 of the stem retainer 48 for holding the perpendicular alignment of the bottom plate 40 relative to the center stem assembly 20. The stem sleeve 48 can have a shoulder rim 60 in interference fit engagement with the bearing ring 58 to secure the bottom plate 40 to the center stem assembly 20. Again, the perimeter stem assemblies 90 remain cooperative with these components to maintain position and alignment.

FIGS. 4-5 show an embodiment of the sealing means 50. The sealing means 50 can include an O-ring 62 on the outer circumference 44 of the bottom plate 40. In some embodiments, there is another O-ring 64. The O-rings 62, 64 form the sealing engagement on the inner flange surface 72 of the flange assembly 70. The sealing diameter 82 of the inner flange surface 72 and the O-rings 62, 64 on the outer circumference 44 at the lower surface diameter 88 form a seal engagement between the bottom plate 40 and inner flange surface 72 of the flange assembly 70. FIGS. 3-4 further show a pipe plug 66 placed on the upper surface 42 of the bottom plate 40. The pipe plug 66 forms a port 68 so as to test the O-ring seal between the bottom plate 40 and the flange assembly 70. The pipe plug 66 and the port 68 are no longer attached to flange assembly 70. The bottom plate 40 is not required to reach a certain depth in the flange assembly 70 in order to test the sealing engagement. Furthermore, the exterior of the flange assembly 70 can remain clear and uniform. The pipe plug 66 remain accessible to test a seal without any relationship to the outer flange surface 74 of the flange assembly 70.

FIG. 5 also shows embodiments of the flange assembly 70. The transition portion 78 is tapered from the sealing portion 76 to the connection portion 80. In some embodiments, the transition portion 78 is tapered from a respective inner flange surface 72 of the sealing portion 76 to a respective inner flange surface 72 of the connection portion 80. FIG. 5 also shows respective outer flange surfaces 74 of the connection portion 80, the transition portion 78, and the sealing portion 76 being linearly aligned so as to form a single straight outer flange surface. The connection portion 80 has a larger diameter and thinner thickness than the sealing portion 76. The welding diameter 84 is larger than the sealing diameter 82. The connection portion 80 absorbs any welding deformation, during installation of the system 10 on a suction pile. The sealing portion 76 remains stable and will see minimal, if any, deformation from the welding process. Additionally, the transition portion 78 directs flow through the flange assembly 70 without sharp rims and edges to impede flow. In alternative embodiments, the transition portion 78 is tapered inward from the outer flange surface 74 with the inner flange surface 72 remaining straight down. In this alternative embodiment, the sealing diameter 82 remains the smallest diameter and the flow diameter through the flange assembly 70. There can also be smaller flared or beveled end portions for the weld material at the rim of the connection portion 80.

When the suction pile water is pumped out to penetrate the pile from an embedded position to a set position on the ocean floor, the closing lip 52 and the sealing engagement of the sealing means 50 hold the position. In these conditions with exterior top pressure on the bottom plate 40, the upper surface diameter 86 is larger than the sealing diameter 82. The closing lip 52 at the upper surface diameter 86 cannot fit through the sealing diameter 82 of the sealing portion 76 at the top of the flange assembly 70. When extracting to reset the suction pile, there is bottom pressure from under the bottom plate 40. In these conditions with bottom or lower pressure under the bottom plate 40, the welding diameter 84 is larger than the sealing diameter 82. In the present invention, the force required to contain the bottom plate 40 per flow area through the flange assembly 70 is lower than the prior art systems. In the prior art, the flange assemblies have a smaller diameter below the sealing diameter to create a shelf to support a bottom plate against top pressure, similar to the closing lip 52 and sealing portion 76 of the present invention. However, these prior art structures increase the force on the bottom plate. The smaller diameter as the flow diameter for fluid through the flange assembly exerts more force to keep a flow rate. The additional components of prior art systems, such as a guide rod retainer, further restrict flow and further increase force on the bottom plate. In the present invention, the sealing diameter 82 is smaller than the welding diameter 84 so as to be the flow diameter, instead of a smaller diameter or guide rod retainer obstructed flow path of the prior art. The bottom pressure from under the bottom plate 40 is reduced with the sealing diameter 82 as the smaller flow diameter of the flange assembly 70 and with removal of other obstructions or flow restrictors through the system 10. Additionally, the present invention includes the transition portion 78 of the flange assembly 70. The tapering from the welding diameter 88 to the sealing diameter 82 allows water flow to also transition with less force and gaps in comparison to sharp ledges and straight down falls in the prior art. The present invention reduces stress and force on the system 10 so that the threaded stem portion 28 of the center stem assembly 20, the threaded center top plate hole 14 of the top plate 12, and the top plate 12 held in position by the perimeter stem assemblies 90 are sufficient to withstand bottom pressure from under the bottom plate 40. Prior art systems require more than the threaded engagements of the present invention, and additional supports and components are no longer needed.

The present invention provides a vent cap system for a suction pile. The vent cap system actuates a bottom plate between a closed position and an opened position in very limited space. The opened position corresponds to allowing flow through the suction pile, such as during deployment and embedding on the ocean floor. The closed position corresponds to pumping out air and any fluid from the suction pile to penetrate from an embedded position to a set position on the ocean floor. The vent cap system of the present invention has improved cost efficiency in manufacturing. Less materials are used because the sealing diameter of the present invention, as the smallest diameter and the flow diameter, reduces the bottom pressure from under the bottom plate. The threaded engagements between the center stem assembly and top plate are now sufficient to withstand this lower bottom pressure from under the bottom plate. There is also less force on the top plate to secure the threaded engagements for the bottom plate, so the top plate requires less support and fewer components. There is also less force on the perimeter stem assemblies that secure the top plate. The top plate and the perimeter stem assemblies can have reduced bulk and material. Additionally, the perimeter stem assemblies and stem retainer cooperate to maintain alignment of the bottom plate relative to the flange assembly during movement between opened and closed positions. Separate guidance components, like a guide rod assembly, are no longer required.

The present invention also provides a vent cap system that secures the seal of the bottom plate to the flange assembly in the closed position. The pipe plug to test the sealing engagement is now on the bottom plate so that there no interface required with the flange assembly in order test the seal. The closing lip sets the fully closed position. Top pressure above the bottom plate abuts the closing lip to the flange assembly due to the larger diameter of the closing lip. The outer surface diameter of the bottom plate at the closing lip is larger than the sealing diameter of the flange assembly. Force on the bottom plate is reduced because the sealing diameter is smaller than the sealing diameter of the prior art relative to other diameters in the flange assembly. The sealing diameter of the present invention is the smallest diameter relative to other diameters, like the welding diameter, so as to determine flow diameter and force on the bottom plate, while the sealing diameter of the prior art is not the smallest diameter relative to the other diameters. The smallest diameter, not the sealing diameter, of the prior art determines flow diameter and the force on the bottom plate, which is larger than the force in the present invention. Embodiments of the invention also include the connection portion of the flange assembly with a welding diameter larger than the sealing diameter and smaller thickness. The weld deformation to attach to the suction pile now only affects the connection portion, instead of the entire flange assembly. The sealing portion remains unaffected by the weld deformation so that the sealing engagement cannot be damaged by the installation on the suction pile.

The foregoing disclosure and description of the invention is illustrative and explanatory thereof. Various changes in the details of the described method can be made without departing from the true spirit of the invention.

I claim:

1. A vent cap system, comprising:

a top plate having a threaded center top plate hole;

a center stem assembly being comprised of a center stem handle, and a center stem bolt body, said center stem bolt body having a distal end, a threaded stem portion, and a proximal end opposite said distal end, said threaded stem portion being between said distal end and said proximal end, wherein said center stem handle is mounted on said distal end above said top plate, and wherein said threaded center stem bolt body is extended through said top plate;

a bottom plate having an upper surface, an outer circumference, and a lower surface opposite said top surface and being comprised of a stem retainer and a sealing means, wherein said threaded stem portion is in threaded engagement with said threaded center top plate hole so as to set alignment of said bottom plate relative to said top plate, wherein said stem retainer is centered on said upper surface of said bottom plate and removably attached to said center stem bolt body, wherein said upper surface has an upper surface diameter larger than a lower surface diameter of said lower surface so as to form a closing lip, wherein said sealing means is positioned on said outer circumference and below said closing lip, wherein said proximal end of said center stem bolt body is attached to said bottom plate, a flange assembly having an inner flange surface and an outer flange surface opposite said inner flange surface and being comprised of a sealing portion, a transition portion, and a connection portion, said sealing portion facing toward said top plate, said connection portion facing away from said top plate, said transition portion being between said sealing portion and said connection portion, wherein said sealing portion has a sealing diameter, and wherein said connection portion has a welding diameter, said sealing diameter being smaller than said welding diameter, said upper surface of said bottom plate having a larger diameter than said sealing diameter, said outer circumference being in removable sealing engagement with said flange assembly at said sealing portion; and a plurality of perimeter stem assemblies, each perimeter stem assembly being arranged on a perimeter of said flange assembly so as to maintain position of said top plate relative to said flange assembly during raising and lowering of said bottom plate between an opened position and a closed position, wherein said perimeter stem assemblies are in sliding engagement with said bottom plate so as to guide said bottom plate between said opened position and said closed position and maintain said alignment of said bottom plate relative to said top plate by said threaded stem portion.

2. The vent cap system, according to claim 1, wherein said stem retainer is comprised of a mounting plate attached to said upper surface of said bottom plate, and a stem sleeve orthogonal to said mounting plate, said stem sleeve being attached to said center stem assembly.

3. The vent cap system, according to claim 2, wherein said stem sleeve extends upward from said mounting plate toward said top plate.

4. The vent cap system, according to claim 2, wherein said center stem assembly has a retainer groove positioned on said center stem bolt body so as to be enclosed by said stem retainer.

5. The vent cap system, according to claim 4, further comprising: a bearing ring within said retainer groove, said bearing ring being slip fit between said center stem assembly and said stem sleeve of said stem retainer.

6. The vent cap system, according to claim 5, wherein said stem sleeve is comprised of a shoulder rim in interference fit engagement with said bearing ring.

7. The vent cap system, according to claim 1, wherein said sealing means comprises an O-ring on said outer circumference of said bottom plate.

8. The vent cap system, according to claim 7, wherein said sealing means further comprises another O-ring on said outer circumference of said bottom plate.

9. The vent cap system, according to claim 8, further comprising: a pipe plug placed on said upper surface of said bottom plate, said pipe plug forming a port so as to test an O-ring seal between said bottom plate and said flange assembly.

10. The vent cap system, according to claim 1, wherein said closing lip is in abutment to said sealing portion in said closed position of said bottom plate.

11. The vent cap system, according to claim 1, wherein said transition portion is tapered from said sealing portion to said connection portion.

12. The vent cap system, according to claim 11, wherein said transition portion is tapered from a respective inner flange surface of said sealing portion to a respective inner flange surface of said connection portion.

13. The vent cap system, according to claim 12, wherein respective outer flange surfaces of said connection portion, said transition portion, and said sealing portion are linearly aligned so as to form a single straight outer flange surface.

14. The vent cap system, according to claim 13, wherein said connection portion has a larger diameter and thinner thickness than said sealing portion.

15. The vent cap system, according to claim 1, wherein said perimeter stem assemblies are radially arranged around said perimeter.

16. The vent cap system, according to claim 1, wherein said perimeter stem assemblies are selected from a group consisting of T-handles and hex bolts.

* * * * *